US011359336B2

(12) United States Patent
Hopkins

(10) Patent No.: US 11,359,336 B2
(45) Date of Patent: Jun. 14, 2022

(54) RAILROAD TIE PRESERVATION SYSTEM

(71) Applicant: Archie Hartford Hopkins, Maryville, TN (US)

(72) Inventor: Archie Hartford Hopkins, Maryville, TN (US)

( * ) Notice: Subject to any disclaimer, the term of this patent is extended or adjusted under 35 U.S.C. 154(b) by 356 days.

(21) Appl. No.: 16/574,548

(22) Filed: Sep. 18, 2019

(65) Prior Publication Data

US 2020/0095734 A1 Mar. 26, 2020

Related U.S. Application Data

(60) Provisional application No. 62/733,910, filed on Sep. 20, 2018.

(51) Int. Cl.

| | |
|---|---|
| ***E01B 31/24*** | (2006.01) |
| ***B05C 11/10*** | (2006.01) |
| ***B05C 5/02*** | (2006.01) |
| ***B05B 5/12*** | (2006.01) |
| ***B05C 7/02*** | (2006.01) |
| ***B27M 3/14*** | (2006.01) |
| *B08B 5/02* | (2006.01) |

(52) U.S. Cl.

CPC ..... *E01B 31/24* (2013.01); *B05B 5/12* (2013.01); *B05C 5/0212* (2013.01); *B05C 7/02* (2013.01); *B05C 11/1042* (2013.01); *B27M 3/14* (2013.01); *B08B 5/02* (2013.01)

(58) Field of Classification Search

USPC ..... 118/72, 62, 63, 305, 306, 323, 317, 408; 239/172, 173; 104/9, 16, 307, 279; 105/72.2

See application file for complete search history.

(56) References Cited

U.S. PATENT DOCUMENTS

| | | | | |
|---|---|---|---|---|
| 3,638,433 | A * | 2/1972 | Sherard | E02D 5/72 405/50 |
| 4,921,732 | A * | 5/1990 | Bounds | B05B 12/122 427/325 |
| 9,617,692 | B2 * | 4/2017 | Brenny | E01B 31/24 |
| 2018/0163348 | A1 * | 6/2018 | Delmonico | B05B 13/06 |
| 2019/0257036 | A1 * | 8/2019 | Szynakiewicz | E01B 37/00 |

* cited by examiner

*Primary Examiner* — Yewebdar T Tadesse
(74) *Attorney, Agent, or Firm* — Pitts & Lake, P.C.

(57) ABSTRACT

A system of treating installed railroad ties, comprising a conveyance vehicle configured to move along a railroad track, one or more drill carriages slidably attached to the conveyance vehicle to drill one or more holes at predetermined locations in the railroad ties, an air dispenser configured to deliver a blast of air proximate the one or more holes sufficient to remove debris from and around the one or more holes, a preservative dispenser configured to deliver a predetermined amount of preservative material into the one or more holes, and a plug dispenser configured to deliver a plugging material to the one or more holes to seal the preservative material in the one or more holes.

12 Claims, 3 Drawing Sheets

RAILROAD TIE PRESERVATION SYSTEM

CROSS-REFERENCE TO RELATED APPLICATIONS

This application claims the benefit of U.S. Provisional Application No. 62/733,910, filed on Sep. 20, 2018.

FIELD OF INVENTION

The present general inventive concept relates to a system and method for treating railroad ties.

BACKGROUND

It is known to treat a multitude of wood products, including railroad ties, using various chemical products for protection against wood rot, fungal decay and wood-destroying insects such as termites. Prior treatment systems have been less than satisfactory in providing a system for treating railroad ties which are already installed and in use, and which may already be indicating signs of wear. Although it is possible to replace the individual ties which have exceeded their useful life, such an approach is both costly, and necessitates down time for the railroad track.

Studies have generally shown that treatment provided within ten years of installation of the railroad ties is most effective and can increase the useful life of the ties by twofold. Given the exceedingly large volume of existing track in use, it would be beneficial to provide an efficient method for treating installed railroad ties while they are in place, to maximize the useful life of installed railroad ties and to minimize track down time.

BRIEF SUMMARY

The present general inventive concept provides a system of treating installed railroad ties, comprising a conveyance vehicle configured to move along a railroad track, one or more drill carriages slidably attached to the conveyance vehicle to drill one or more holes at predetermined locations in the railroad ties, an air dispenser configured to deliver a blast of air proximate the one or more holes sufficient to remove debris from and around the one or more holes, a preservative dispenser configured to deliver a predetermined amount of preservative material into the one or more holes, and a plug dispenser configured to deliver a plugging material to the one or more holes to seal the preservative material in the one or more holes.

The present general inventive concept further provides a method of treating installed railroad ties comprising configuring a conveyance vehicle to move along railroad tracks, slidably mounting one or more drills to the conveyance vehicle, the one or more drills being configured to drill one or more holes at predetermined locations in the railroad ties, mounting an air dispenser to the conveyance vehicle to deliver a blast of air proximate the one or more holes sufficient to remove debris from and around the one or more holes, mounting a preservative dispenser to the conveyance vehicle to deliver a predetermined amount of preservative material into the one or more holes; and mounting a plug dispenser to the conveyance vehicle to deliver a plugging material to the one or more holes to seal the preservative material in the one or more holes.

BRIEF DESCRIPTION OF THE FIGURES

The following example embodiments are representative of exemplary techniques and structures designed to carry out the objectives of the present general inventive concept, but the present general inventive concept is not limited to these example embodiments. Moreover, in the accompanying drawings and illustrations, the sizes and relative sizes, shapes, and qualities of lines, entities, and regions may be exaggerated for clarity. A wide variety of additional embodiments will be more readily understood and appreciated through the following detailed description of the exemplary embodiments, with reference to the accompanying drawings in which.

DETAILED DESCRIPTION

Reference will now be made to the example embodiments of the present general inventive concept, examples of which are illustrated in the accompanying drawings and illustrations. The example embodiments are described herein in order to explain the present general inventive concept by referring to the figures.

The example embodiments are described herein in order to explain the present general inventive concept by referring to the figures. The following detailed description is provided to assist the reader in gaining a comprehensive understanding of the structures and fabrication techniques described herein. Accordingly, various changes, modification, and equivalents of the structures and fabrication techniques described herein will be suggested to those of ordinary skill in the art. The progression of fabrication operations described are merely examples, however, and the sequence type of operations is not limited to that set forth herein and may be changed as is known in the art, with the exception of operations necessarily occurring in a certain order. Also, description of well-known functions and constructions may be omitted for increased clarity and conciseness. Although example embodiments the present general inventive concept will be particularly described as being applied to a system for securely receiving and storing items delivered to a home or residence, it will be appreciated that the present general inventive concept can be applied to a variety of other uses including commercial applications.

Figure 2:
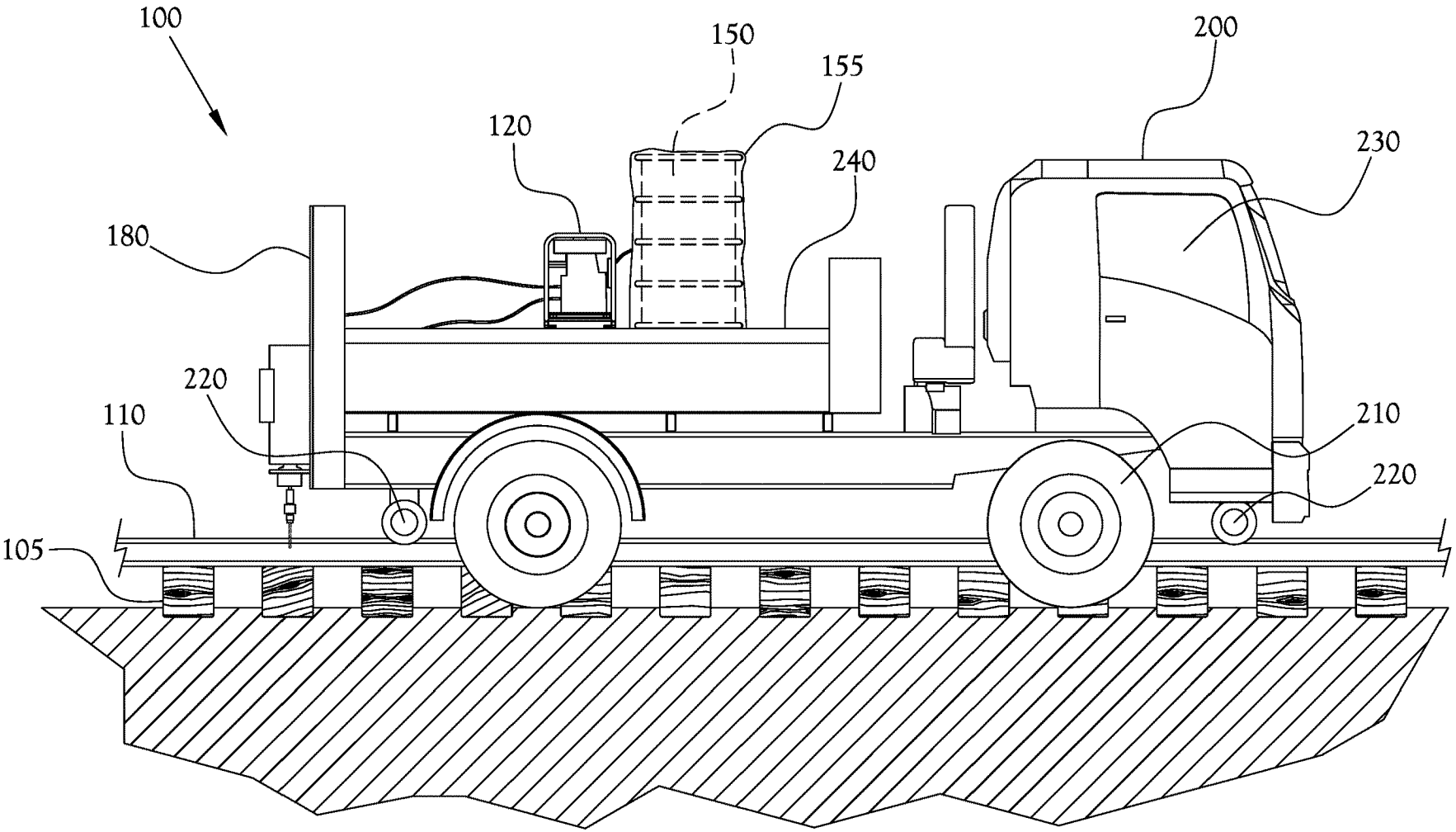
FIG. 2 is a side view of a railroad tie preservation system, showing a flat-bed truck, according to an example embodiment of the present general inventive concept.

Example embodiments of the present general inventive concept provide a system 100 for treating installed railroad ties 105. In some embodiments, a modified truck 200 (as shown in FIG. 2) can be configured to move along the track rails 110. The truck 200 can be driven by an operator, manually pushed or pulled, or remotely operated. The truck 200 may be fitted with materials and equipment for treating the ties 105, including a power generation system 120, various drills 130 and bits 140, preservative storage containers 150, hydraulic and/or pneumatic drives, air nozzles 160, preservative spray or delivery nozzles 170, among other items. A slidable frame system 180 on the truck 200 may be utilized to provide for precise positioning of the drill carriage 130, plug/seal delivery system, and the chemical/preservative applications. In addition, so as to be able to clear the rails 110 when moving between desired treatment hole locations, the drill carriage 130 may be configured to be automatically or manually lowered to the proper height upon positioning, and then raised after each of the holes are drilled for movement of the drill carriage(s) 130 to the next treatment hole location. The slidable frame system 180 may be attached to a support frame 190 on the truck 200.

The operator can reside within the cab of the truck 200 and can operate the controls remotely. The power generation system 120 may include gasoline, diesel, propane, natural gas or any other type model known in the art. In addition to the power generation system 120, one or more air compressors and hydraulic pumps may reside on the truck 200. In an alternative embodiment, a multiple purpose unit can be used, in place of the individual components. This may consist of a rotary-screw air compressor, hydraulic pump, power generation system, and diesel engine in a single unit, which may be used to perform the chemical preservation treatments on the railroad ties 105.

In example embodiments of the invention, truck tires 210 can be used to maintain contact with the track rails 110 and drive the truck 200 along the track rails 110, while rail wells or rail guide wheels 220 can be attached to the truck 200 to keep the truck 200 and system 100 aligned with the track rails 110. The rail guide wheels 220 may be operated by a hydraulic jack or other means chosen using sound engineering judgement. The rail guide wheels 220 may also be lowered manually. The trucks 200 may be two-wheel drive vehicles or four-wheel drive vehicles, although a four-wheel drive vehicle may have a heavier suspension that comes standard to deal with the extra weight from the extra materials on the truck 200 as well as the hydraulic activated rail guide frames. To enter on the track rails 110, the driver of the truck 200 can find a railroad crossing, line up the truck 200 with the track rails 110, and lower the rail guide wheels 220 until the rail guide wheels 220 rest on the track rails 110.

Once the truck 200 or other conveyance vehicle is in place, one or more drills 130 may be moved into a desired spot by moving the slidable frame 180 and attached drill 130 in a lateral direction. The drills 130 can then be lowered into position relative to the railroad tie 105, and holes drilled to a desired depth. The drills 130 may be remotely controlled by the operator from the truck cab 230 or other operator station of the truck 200. In one embodiment, two drills 130 are set at a constant distance apart. Four holes may then be drilled in the railroad tie 105, two at a time, and the process can be controlled with hydraulics. The drilling can be automated or can be done manually, as the need may arise. A camera can be used to locate the drills 130 and to view and/or record the operation of the drill 130 to ensure precision, which can be viewed by the operator from the truck cab 230.

After the holes have been drilled into the railroad tie 105, an air compressor nozzle 160 system may be used to spray a burst of air in and around the hole to remove any debris from the drill site. The air nozzle(s) 160 may be directed to the holes after each hole has been drilled, or after all the holes in a railroad tie 105 have been completed. Distributing the air spray can be performed automatically, or can be done manually, as the need may arise.

Once the holes have been drilled into the railroad tie 105 and the debris has been removed, the preservative materials or chemicals can be delivered into the hole. A pneumatic preservative delivery nozzle 170 can be controlled by the operator within the cab 230. The process can be controlled by instructions from a controller unit. For example, Spraying Systems Co.® makes the 1000+ AutoJet® spray control panel. This system requires external power 90-230 VAC, 50/60 Hz, 24 VDC operation, 3 A max. total available for nozzle and sensors. The model plugs into any 120 V/15 A receptacle. This system provides the following features: 2 independent timing channels, remote/local trigger, tank low input for each channel, can be enabled/disabled, password protection, 4 levels, diagnostics screen showing all I/O for easy troubleshooting, and LED indicator on panel, solid green=system ok, flashes=system fault.

The precise amount of chemical to be delivered can be controlled by the controller unit. A mixer can reside on the truck 200 in cooperation with the preservative storage container 150 to ensure that the chemicals are constantly agitated, and heating pads or insulators 155 may be used to maintain constant temperature of the chemicals within the preservative storage containers 150.

After the chemical treatment is delivered into the holes, plugs 300 may be used to seal the drilled hole and to keep out moisture from the treated area. These plugs 130 may be made of hard plastic, rubber, or other solid material impervious to moisture, although other embodiments are possible. A plug dispenser (not shown) can reside on the truck 200 or other conveyance vehicle to hold the plugs 130 prior to usage. A press device can be used to press the plugs 130 into the holes. Alternatively, an air compression tool may also be used to shoot the plugs 130 into place. Compaction of the plugs 130 may be performed by video feed within the cab 230 of the truck 200.

It is possible to plug the holes with other material configured to keep the preservative material inside the railroad ties 105. For example, in order to seal the drilled hole and to keep out moisture, various additives may be placed within the drilled hole after the chemical treatment has been dispensed. This may include glues, resins, epoxies, or other materials that will cure relatively quickly and will not react with the chemical preservative treatment. The same type of chemical preservative dispenser 170 and sprayer may be used to fill the hole with the tie 105 preservation additive, although it may be necessary to keep the chemicals and additives isolated from one another so as to not alter their chemical composition and properties.

Although example embodiments of the conveyance vehicle have generally been described with respect to a truck 200, the present general inventive concept is not limited to any particular type of conveyance vehicle and can encompass various types of vehicles, such as retro-fitted trucks, cars, carts, etc. For example, in some embodiments a handcar may be used which may be useful in cases where a smaller number of ties are to be treated and it would not be necessary to utilize a full motorized truck 200. Because of their low weight and small size, a handcar can be put on and taken off the rails at any place, allowing trains to pass.

Alternatively, railway motor cars may be used in place of handcars. Although slower than a train, these vehicles do not rely on human locomotion. They will also be able to accommodate the materials necessary to treat the railroad ties 105, and may also have a climate-controlled compartment, so that the operator is protected from the climate, and work may be performed on the ties 105 during periods of excessively hot or cold weather.

The attached FIGS. 1-4 illustrate various examples of the described railroad tie preservation system 100 configured for use in accordance with example embodiments of the present general inventive concept.

Figure 1:
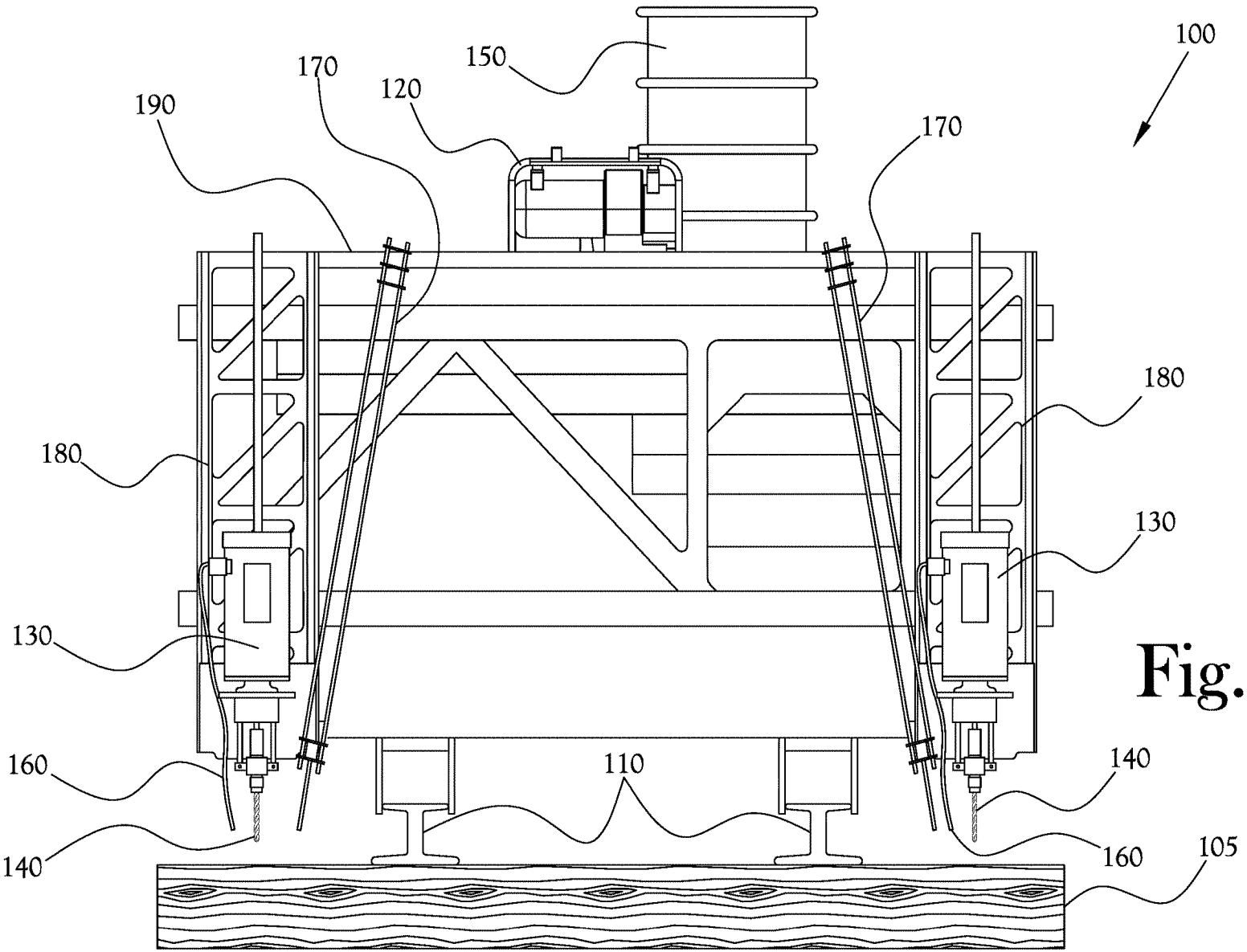
FIG. 1 is a front view of a railroad tie preservation system according to an example embodiment of the present general inventive concept.

FIG. 1 shows an embodiment of the invention with two drills 130 or carriages attached to the slidable frame 180. In this view, the both drills 130 are shown with attached bits 140 for drilling holes into the railroad ties 105. In one example embodiment, the two drills 130 are maintained at a constant distance apart and the holes are drilled into the railroad ties 130 simultaneously. Once the two holes have been drilled, the drills 130 may be lifted up above the elevation of the rail 110, so that the attached bits 140 do not come into contact with the rail 110, moved laterally into position with respect to the railroad tie 105, lowered into position above the rail road ties 105, and two more holes drilled. Although the embodiment described above provides for 4 holes to be drilled into each railroad tie 105, any number of holes may be drilled in the railroad ties 105.

Also shown in FIG. 1 are the air nozzles 160 for blowing out the debris after the holes have been drilled. The air nozzles 160 are shown in the general proximity of the drill bit 140 and typically do not require a precise location to perform their function, although the air nozzles 160 may also be attached to the drill 130 and may be controlled in an automated fashion by the operator.

Also shown in FIG. 1 are the preservative spray or delivery nozzles 170. A pneumatic preservative delivery nozzle 170 can be controlled by the operator within the cab 230. The process can be controlled by instructions from a controller unit. The precise amount of chemical to be delivered can be controlled by the controller unit. The preservative spray nozzles 170 are shown in FIG. 1 as attached to the support frame 190, in a rotating fashion, but these could also be attached directly to the sliding frame 180 and can be operated in an automated fashion, similar to the drill 130 function.

As illustrated in FIG. 2, the trucks tires 210 can be configured to rest outside the track rails 110 on the railroad ties 105, with the rail guide wheels 220 on the track rails 110, during the operation of the system. In one embodiment, the truck 200 has dual wheels in the rear, and in this case, one set of tires 210 may rest on the rails 110. Also shown in the figure are the rail guide wheels 220. In this example, both of the rail guide wheels 220 are resting on the track rail 110. In this configuration, the truck tires 210 can drive the truck 200 along the track rails 110, while the rail guide wheels 220 maintains lateral alignment while the truck 200 is in motion. Above the truck wheels is shown the truck bed 240, and a partial view of the slidable frame 180. The truck bed 240 provides a location for holding all the various materials that may be used to treat the railroad ties 105.

FIG. 2 also shows an example of an insulating pad 155 which may also contain an electrical heating element. The heating element may operate on standard AC voltage with an attached temperature control device. As mentioned in the discussion above, the temperature of the chemical may have to remain relatively constant, in spite of variability in the climate conditions during treatment, in order to function properly as a preservative for the railroad ties 105.

Figure 3B:
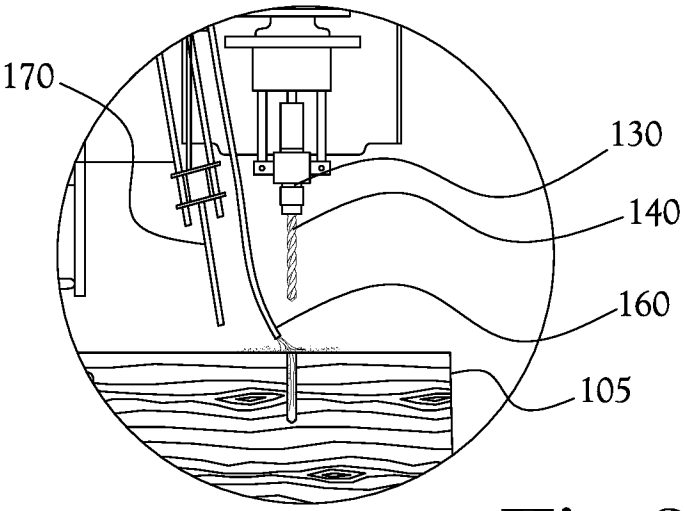
FIG. 3B is a close-up view of a railroad tie preservation system, showing an air dispenser, according to an example embodiment of the present general inventive concept.
Figure 3A:
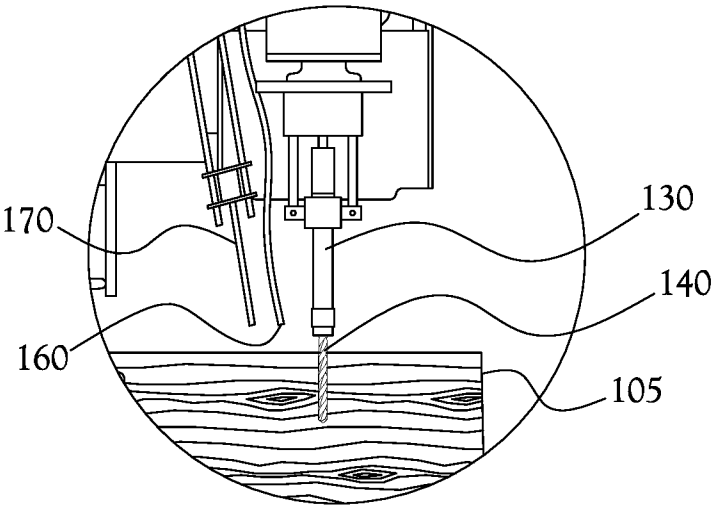
FIG. 3A is a close-up view of a railroad tie preservation system, showing a drill, according to an example embodiment of the present general inventive concept.
Figure 3C:
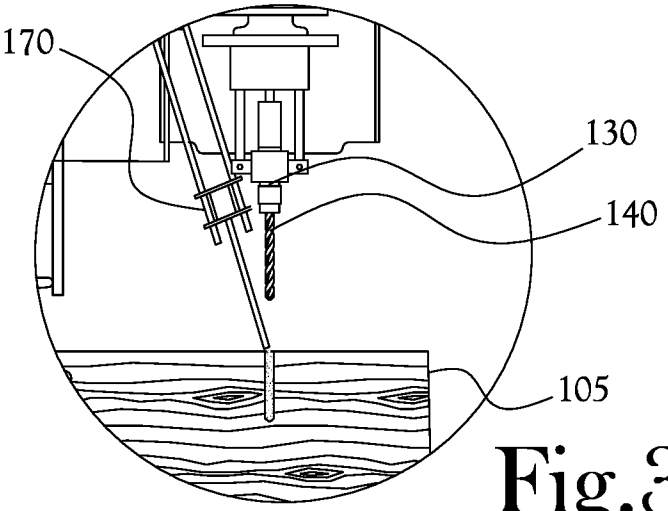
FIG. 3C is a close-up view of a railroad tie preservation system, showing a preservative dispenser, according to an example embodiment of the present general inventive concept.

FIGS. 3A-3B show close up views of the system 100 performing the method of the present general inventive concept. FIG. 3A shows the drill 130 inserting a hole into the railroad tie 105. FIG. 3B shows the air nozzle 160 removing the debris left over from the drilling process. FIG. 3C shows a preservative delivery nozzle 170 used for treating the railroad tie 105 with the preservative chemical.

Figure 4:
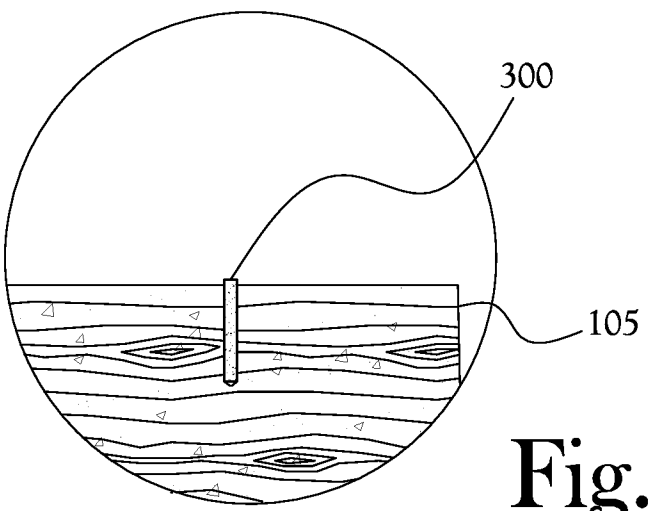
FIG. 4 is a close-up view of a railroad tie preservation system, showing a plug, according to an example embodiment of the present general inventive concept.

FIG. 4 shows a railroad tie 105 according to one embodiment of the present general inventive concept. On the right of the figure, a plug 300 is shown fully inserted into the drilled hole to ensure that water does not pool in the area where the hole has been drilled. As described above, the plug may be made from a variety of solid materials, and is used to fill the holes in the railroad ties 105. It also may be made from glues, resins, epoxies, or other materials that will cure relatively quickly and will not react with the chemical treatment.

It is noted that the simplified diagrams and drawings do not illustrate all the various connections and assemblies of the various components, however, those skilled in the art will understand how to implement such connections and assemblies, based on the illustrated components, figures, and descriptions provided herein, using sound engineering judgment.

Numerous variations, modifications, and additional embodiments are possible, and accordingly, all such variations, modifications, and embodiments are to be regarded as being within the spirit and scope of the present general inventive concept. For example, regardless of the content of any portion of this application, unless clearly specified to the contrary, there is no requirement for the inclusion in any claim herein or of any application claiming priority hereto of any particular described or illustrated activity or element, any particular sequence of such activities, or any particular interrelationship of such elements. Moreover, any activity can be repeated, any activity can be performed by multiple entities, and/or any element can be duplicated.

While example embodiments have been illustrated and described, it will be understood that the present general inventive concept is not intended to limit the disclosure, but rather it is intended to cover all modifications and alternate devices and methods falling within the spirit and the scope of the invention as defined in the appended claims.

The invention claimed is:

1. A system of treating installed railroad ties, comprising:

a conveyance vehicle configured to move along a railroad track;

one or more drill carriages slidably attached to the conveyance vehicle to drill one or more holes at predetermined locations in the railroad ties;

an air dispenser configured to deliver a blast of air proximate the one or more holes sufficient to remove debris from and around the one or more holes;

a preservative dispenser configured to deliver a predetermined amount of preservative material into the one or more holes; and a plug dispenser configured to deliver a plugging material to the one or more holes to seal the preservative material in the one or more holes.

2. The system of claim 1, further comprising a camera unit attached to the conveyance vehicle to locate the one or more drill carriages relative to the railroad ties.

3. The system of claim 2, including a controller unit configured to control the treatment of the railroad ties.

4. The system of claim 3, wherein the controller unit includes a user interface configured to receive inputs from an operator and provide information regarding the treatment of the railroad ties to the operator.

5. The system of claim 1, wherein the preservative dispenser includes an agitation unit and a heating unit to agitate and heat preservative material stored in the preservative dispenser.

6. The system of claim 5, wherein the preservative dispenser is configured to deliver the predetermined amount of preservative material automatically.

7. The system of claim 5, wherein the preservative dispenser includes an insulated pad for maintaining the temperature of the preservative material.

8. The system of claim 1, wherein the plugging material includes hard plastic or rubber.

9. The system of claim 1, wherein the plugging material includes one of glues, resins, or epoxies.

10. The system of claim 1, wherein the conveyance vehicle consists of a flat-bed truck.

11. The system of claim 1, wherein the conveyance vehicle consists of a hand car.

12. The system of claim 1, wherein the conveyance vehicle consists of a railway car.

* * * * *